US006077131A

United States Patent [19]

Fukuda et al.

[11] Patent Number: 6,077,131

[45] Date of Patent: Jun. 20, 2000

[54] MALE TERMINAL

[75] Inventors: Kiyohito Fukuda; Masanori Tsuji; Motohisa Kashiyama, all of Shizuoka, Japan

[73] Assignee: Yazaki Corporation, Tokyo, Japan

[21] Appl. No.: 09/182,012

[22] Filed: Oct. 29, 1998

Related U.S. Application Data

[62] Division of application No. 08/797,941, Feb. 12, 1997, abandoned.

[30] Foreign Application Priority Data

Feb. 14, 1996 [JP] Japan ..... 8-26941

[51] Int. Cl.[7] ..... H01R 13/04

[52] U.S. Cl. ..... 439/884

[58] Field of Search ..... 439/884, 885, 439/886, 874

[56] References Cited

U.S. PATENT DOCUMENTS 5,591,054 1/1997 Okada et al. ..... 439/884

*Primary Examiner*—Hien Vu

*Attorney, Agent, or Firm*—Sughrue, Mion, Zinn, Macpeak & Seas, PLLC

[57] ABSTRACT

A male terminal in which a connection portion can be easily shaped, and deformation of the connection portion is prevented so as to ensure an electrical connection of the connection portion to a female terminal. The connection portion is formed at a front end of the male terminal, and is adapted to be electrically connected to a female terminal. The connection portion includes a bottom base portion and a contact portion, and the connection portion is bent and folded, with the contact portion superposed on the bottom base portion. A curved recess (reinforcement portion) is formed by bending at a generally central portion of the contact portion, and the reinforcement portion projects into an internal space of the connection portion, and is held in contact with the bottom base portion. By thus forming the curved reinforcement portion at the contact portion, and by holding the reinforcement portion in contact with the bottom base portion, the strength of the contact portion is increased. Therefore, when an external force acts on the contact portion or the bottom base portion, the contact portion and the bottom base portion are positively prevented from being deformed or crushed into the space.

2 Claims, 6 Drawing Sheets

MALE TERMINAL

This is a divisional of application Ser. No. 08/797,941 filed Feb. 12, 1997, the disclosure of which is incorporated herein by reference.

BACKGROUND OF THE INVENTION

1. Field of the Invention

This invention relates to a male terminal having a connection portion for connection to a female terminal which connection portion is formed by bending an electrically-conductive sheet material.

2. Background

A male terminal 30 shown in FIG. 11 is formed by bending an electrically-conductive sheet material, and has a clamping portion 31 and a connection portion 32. The clamping portion 31 includes a pair of wire sheath clamping portions 33 and 33, and a pair of conductor clamping portions 34 and 34. A sheath 35*a* of a wire 35 is clamped by the pair of wire sheath clamping portions 33 and 33, and a conductor 35 is clamped by the pair of conductor clamping portions 34 and 34, and by doing so, the male terminal 30 is fixedly secured to the wire 35. The connection portion 32 is adapted to be electrically connected to a female terminal (not shown), and includes a bottom base portion 36 and a contact portion 37 which are superposed together (see FIG. 12).

However, although the connection portion 32 is so bent and folded that a space will not be formed between the bottom base portion 36 and the contact portion 37 as shown in FIG. 12, the bottom base portion 36 and the contact portion 36 are resiliently deformed away from each other because of spring-back when a bending load is removed. Therefore, it is difficult to form the connection portion 32 into a thickness Tl twice larger than a sheet thickness t of the bottom base portion 36 and the contact portion 37.

Therefore, the connection portion 32 is formed in such a manner that a space 40 is formed between the bottom base portion 36 and the contact portion 37, as shown in FIG. 13, and there may arise a problem that during transport of the male terminal 30, this space 40 is crushed, so that the thickness T2 of the connection portion 32 is changed, which leads to an incomplete electrical connection between the connection portion 32 and the female terminal.

Another problem is that during assembly and maintenance, the space 40 is crushed, so that the thickness T2 of the connection portion 32 is changed, which leads to an incomplete electrical connection between the connection portion 32 and the female terminal.

SUMMARY OF THE INVENTION

An object of this invention is to overcome the above problems, and more specifically to provide a male terminal in which a connection portion can be easily shaped, and deformation of the connection portion is prevented so as to ensure an electrical connection of the connection portion to a female terminal.

The above object of the invention has been achieved by a male terminal including a connection portion having a bottom base portion and a contact portion which are superposed together, and a reinforcement portion is provided in a space between the bottom base portion and the contact portion. The male terminal is made of an electrically-conductive sheet material.

In the male terminal of the above construction, the reinforcement portion is provided in the space between the bottom base portion and the contact portion of the connection portion of the male terminal, and therefore during transport, assembly and maintenance of the male terminal, the bottom base portion and the contact portion are positively prevented from being crushed and deformed. Therefore, an incomplete electrical connection between the connection portion and the female terminal will not occur.

The reinforcement portion is thus provided in the space between the bottom base portion and the contact portion, and therefore even if an external force acts on the bottom base portion or the contact portion during transport, assembly and maintenance of the male terminal, the bottom base portion and the contact portion will not be deformed, and therefore the sheet thickness of the bottom base portion and the contact portion can be reduced, thereby reducing the cost and the weight.

And besides, the space can be positively formed between the bottom base portion and the contact portion, and therefore spring-back, occurring when bending the sheet material so as to superpose the bottom base portion and the contact portion together, can be absorbed by this space, and therefore the connection portion can be formed or shaped easily with high precision. Therefore, the quality and reliability of the male terminal are enhanced.

The reinforcement portion is formed at other portion of the connection portion than a contact area for electrical contact with a female terminal. Therefore, the precision of the position of the reinforcement portion, provided in the space between the bottom base portion and the contact portion, does not need to be so high, and this facilitates the production.

The reinforcement portion is formed by bending the electrically-conductive sheet material. Therefore, the reinforcement portion can be easily formed by bending simultaneously when forming the male terminal by bending the sheet material.

The reinforcement portion is formed by pressing. Therefore, as compared with the case of forming the reinforcement portion by bending the electrically-conductive sheet material, a wide choice of the position of formation of the reinforcement portion can be obtained, and the reinforcement portion can be formed at a suitable position.

DETAILED DESCRIPTION OF THE PREFERRED EMBODIMENTS

Preferred embodiments of male terminals of the present invention will now be described in detail with reference to the drawings.

First Embodiment

Figure 1:
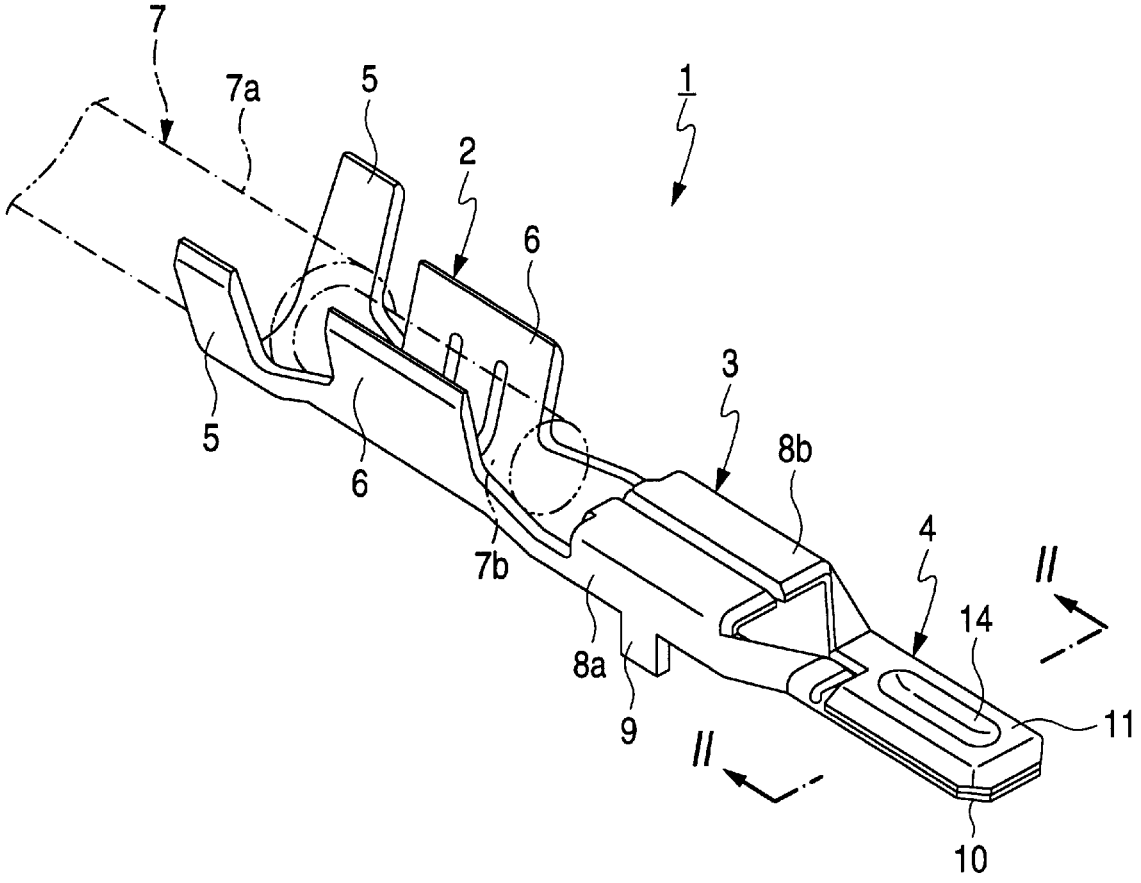
FIG. 1 is a perspective view of a first embodiment of a male terminal of the present invention.
Figure 2:
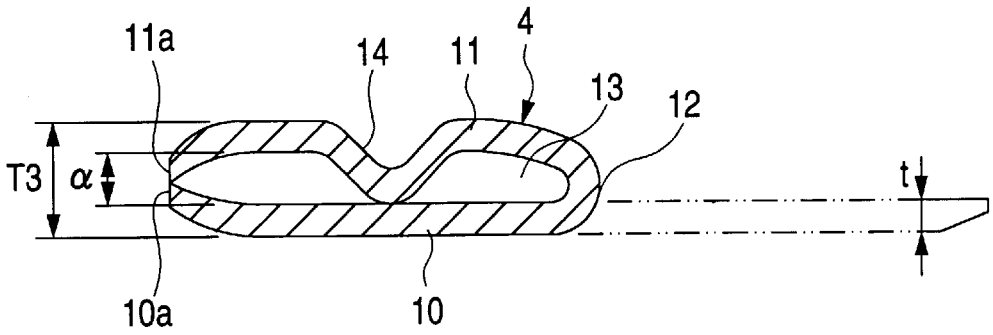
FIG. 2 is a cross-sectional view taken along the line II—II of FIG. 1.

A first embodiment of a male terminal of the invention will first be described with reference to FIGS. 1 and 2. FIG. 1 is a perspective view of the first embodiment of the male terminal of the invention, and FIG. 2 is a cross-sectional view taken along the line II—II of FIG. 1.

As shown in FIG. 1, the male terminal 1 is formed by bending an electrically-conductive sheet material, and has an integral construction. The male terminal 1 includes a clamping portion 2, a retaining portion 3 and a connection portion 4. The clamping portion 2 is formed at a rear end of the male terminal 1, and includes a pair of wire sheath clamping portions 5 and 5, and a pair of conductor clamping portions 6 and 6. A sheath 7*a* of a wire 7 is clamped by the pair of wire sheath clamping portions 5 and 5, and a conductor 7*b* is clamped by the pair of conductor clamping portions 6 and 6, and by doing so, the male terminal 1 is fixedly secured to the wire 7.

The retaining portion 3 is provided at a generally central portion of the male terminal 1, and is formed by opposite side walls 8*a* and 8*b*, and more specifically by bending the opposite side walls 8*a* and 8*b* inwardly, so that the retaining portion 3 has a tubular configuration of a rectangular cross-section. A pair of retaining piece portions 9 and 9 (one of which is not shown in the drawings) extend downwardly respectively from lower edges of the opposite side walls 8*a* and 8*b*. The pair of retaining piece portions 9 are retained within a connector housing (not shown), thereby preventing the male terminal 1 from withdrawal.

The connection portion 4 is formed at a front end of the male terminal 1, and is adapted to be electrically connected to a female terminal. As shown in FIG. 2, the connection portion 4 includes a bottom base portion 10 and a contact portion 11 each of which has a thickness t, and the connection portion 4 is bent and folded at a folding portion 12, with the contact portion 11 superposed on the bottom base portion 10. A side edge 10*a* of the bottom base portion 10 and a side edge 11*a* of the contact portion 11 are abutted together, and a space 13, having a width $\alpha$, is formed between the bottom base portion 10 and the contact portion 11. Therefore, a thickness T3 of the connection portion 4, formed by superposing the contact portion 11 and the bottom base portion 10 together, is represented by $2t+\alpha$. A curved recess (reinforcement portion) 14 is formed by bending at a generally central portion of the contact portion 11, and the reinforcement portion 14 projects into the space 13, and is held in contact with the bottom base portion 10.

By thus forming the curved reinforcement portion 14 at the contact portion 11, the strength of the contact portion 11 is increased. Since the reinforcement portion 14 is held in contact with the bottom base portion 10, the contact portion 11 and the bottom base portion 10 are reinforced by the reinforcement portion 14 against crush. Therefore, when an external force acts on the contact portion 11 or the bottom base portion 10, the contact portion 11 and the bottom base portion 10 are positively prevented from being deformed or crushed into the space 13.

A procedure of forming the connection portion 4 in this embodiment of the above construction will now be described. First, the electrically-conductive sheet material is bent and folded at the folding portion 12 to thereby superpose the contact portion 11 and the bottom base portion 10 together. At this time, the side edge 10*a* of the bottom base portion 10 and the side-edge 11*a* of the contact portion 11 are abutted together, so that the space 13, having the width $\alpha$, is formed between the bottom base portion 10 and the contact portion 11. Then, the curved reinforcement portion 14 is formed at the contact portion 11 by pressing. This reinforcement portion 14 projects into the space 13, and is held in contact with the bottom base portion 10. With this construction, although the space 13 with the width $\alpha$ is formed between the bottom base portion 10 and the contact portion 11, the connection portion 4, having the sufficient strength, can be obtained.

Therefore, when the electrically-conductive sheet material is to be folded at the folding portion 12 so as to superpose the contact portion 11 and the bottom base portion 10 together, the space 13 with the width $\alpha$ can be positively formed between the bottom base portion 10 and the contact portion 11. Therefore, spring-back, occurring when bending the sheet material so as to superpose the contact portion 11 and the bottom base portion 10 together, is absorbed by the space 13, so that the connection portion 4, having the width T3, can be easily-formed. Therefore, the male terminal 1 is stable in quality, and has an enhanced reliability.

The operation of the male terminal of this embodiment having the above construction will now be described. There are occasions when an external force acts on the bottom base portion 10 or the contact portion 11 during transport, assembly and maintenance of the male terminal 1. In the male terminal 1 of this embodiment, however, the curved reinforcement portion 14 is formed at the contact portion 11 to increase the strength of the contact portion 11, and also the reinforcement portion 14 is held in contact with the bottom base portion 10 so as to prevent the space 13 from being crushed. With this construction, the contact portion 11 and the bottom base portion 10 will not be crushed by the external force acting thereon. Therefore, the connection portion 4 can be positively connected electrically to the female terminal.

And besides, since the reinforcement portion 14 is formed at the connection portion 4, the sheet thickness t of the bottom base portion 10 and the contact portion 11 can be reduced, and therefore the cost of the male terminal 1 can be reduced, and also its weight can be reduced.

Second Embodiment

Figure 3:
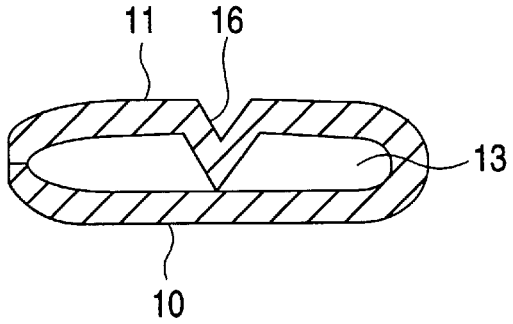
FIG. 3 is a cross-sectional view of a second embodiment of a male terminal of the invention.

Next, a second embodiment of a male terminal of the invention will be described with reference to FIG. 3. Although the curved reinforcement portion 14 is formed at the generally central portion of the contact portion 11 in the first embodiment, a recess (reinforcement portion) 16 of a triangular cross-section is formed in this embodiment as shown in FIG. 3, in which case similar effects can be achieved.

Third Embodiment

Figure 4:
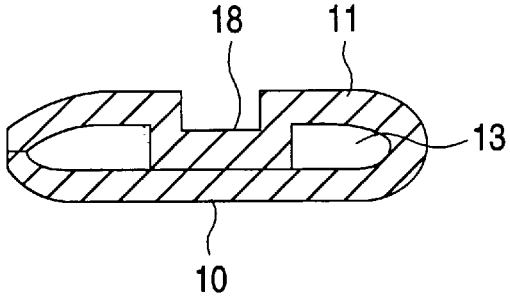
FIG. 4 is a cross-sectional view of a third embodiment of a male terminal of the invention.

Next, a third embodiment of a male terminal of the invention will be described with reference to FIG. 4. In the first and second embodiments, although the curved reinforcement portion 14 and the cross-sectionally triangular reinforcement portion 16 are formed at the generally central portion of the contact portion 11, a recess (reinforcement portion) 18 of a channel-shaped cross-section may be formed. In this embodiment, the reinforcement portion 18 is held in surface-to-surface contact with the bottom base portion 10, and therefore a greater strength can be obtained as compared with the first and second embodiments.

Fourth Embodiment

Figure 5:
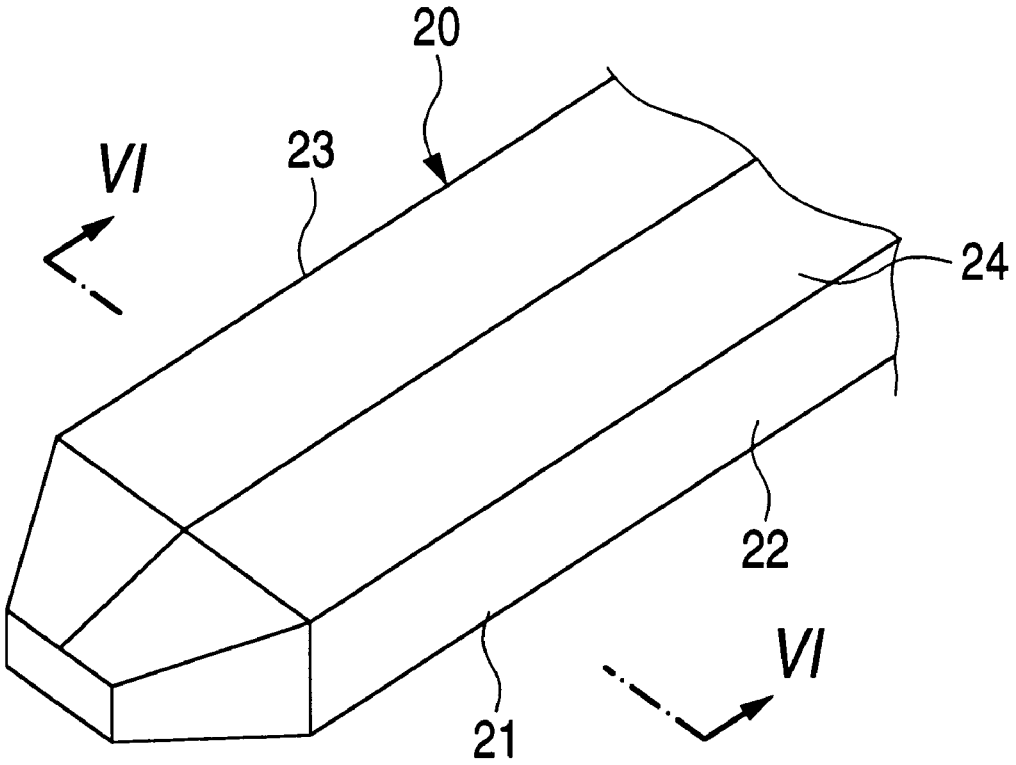
FIG. 5 is a perspective view of a fourth embodiment of a male terminal of the invention.
Figure 6:
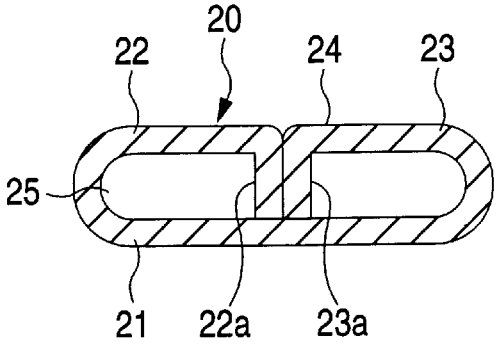
FIG. 6 is a cross-sectional view taken along the line VI—VI of FIG. 5.

Next, a fourth embodiment of a male terminal of the invention will be described with reference to FIGS. 5 and 6. In the above embodiments, the electrically-conductive sheet material is bent and folded at the folding portion 12 to thereby superpose the contact portion 11 and the bottom base portion 10 together to form the connection portion 4. However, in this embodiment, electrically-conductive sheet material is so bent that its opposite side edge portions are disposed at a central portion of a contact portion 24, thereby forming a connection portion 20 as shown in FIG. 5. More specifically, the connection portion 20 is formed by bending opposite side portions 22 and 23 of the sheet material, disposed respectively on opposite sides of a bottom base portion 21, and then by contacting the bent opposite side portions 22 and 23 together at the central portion of the contact portion 24. In this case, opposite side edge portions 22*a* and 23*a* (also known as contact pieces) of the opposite side portions 22 and 23 are bent inwardly into a space 25, and are held in contact with the bottom base portion 21, as shown in FIG. 6. With this construction, the opposite side edge portions 22*a* and 23*a* serve as a reinforcement portion, and effects similar to those of the above embodiments can be achieved.

Fifth Embodiment

Figure 7:
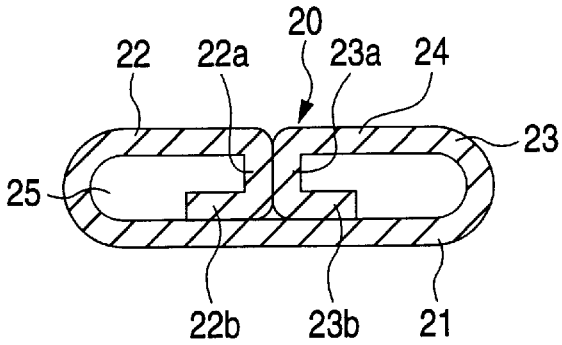
FIG. 7 is a cross-sectional view of a fifth embodiment of a male terminal of the invention.

Next, a fifth embodiment of a male terminal of the invention will be described with reference to FIG. 7. In the preceding embodiment, the opposite side edge portions 22*a* and 23*a* of the opposite side portions 22 and 23, bent inwardly into the space 25, serve as the reinforcement portion. In this embodiment, opposite side edge portions 22*a* and 23*a* of opposite side portions 22 and 23 are further bent through about 90 degrees to form bending portions 22*b* and 23*b* which are held in contact with a bottom base portion 21, as shown in FIG. 7. In this case, the bottom base portion 21 is reinforced by the bending portions 22*b* and 23*b*, and therefore there can be provided the male terminal which has a greater strength as compared with the above embodiments.

Sixth Embodiment

Figure 8:
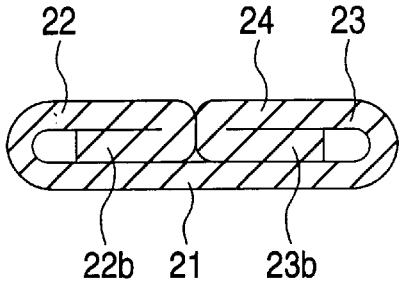
FIG. 8 is a cross-sectional view of a sixth embodiment of a male terminal of the invention.

Next, a sixth embodiment of a male terminal of the invention will be described with reference to FIG. 8. In the above embodiments, although the space 25 is formed between the bottom base portion 10 and the contact portion 11, the formation of the space 25 can be omitted as shown in FIG. 8.

Seventh Embodiment

Figure 9:
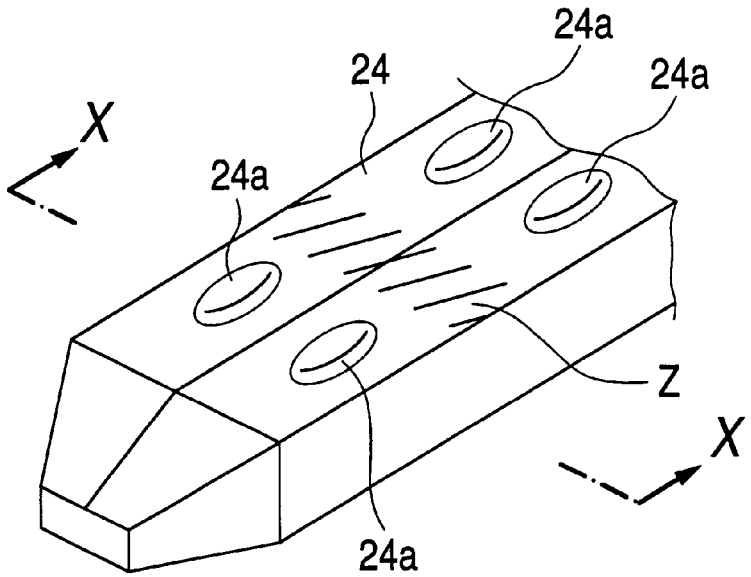
FIG. 9 is a perspective view of a seventh embodiment of a male terminal of the invention.
Figure 10:
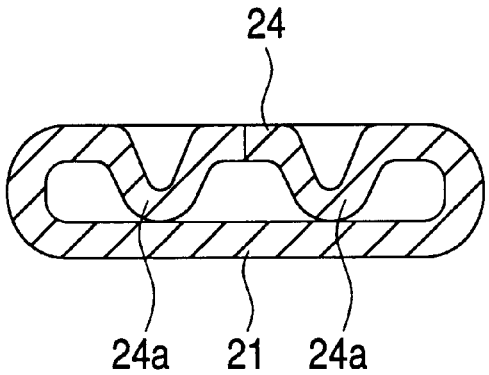
FIG. 10 is a cross-sectional view taken along the line X—X of FIG. 9.
Figure 11:
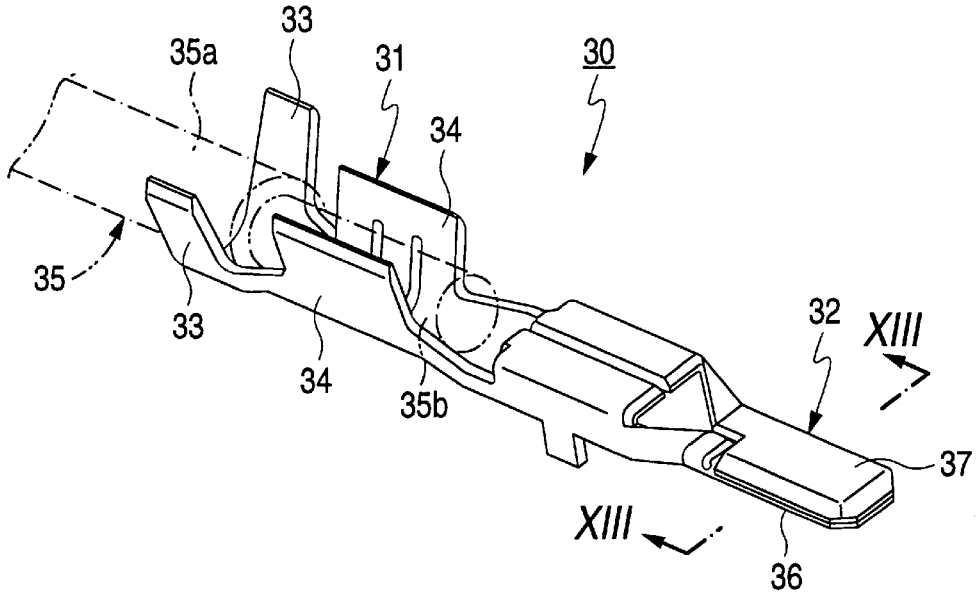
FIG. 11 PRIOR ART
FIG. 11 is a perspective view of a conventional male terminal.
Figure 12:
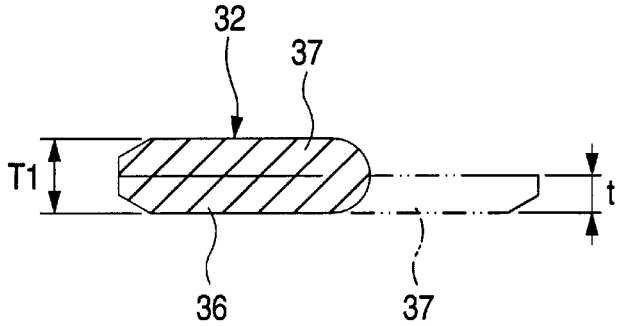
FIG. 12 PRIOR ART
FIG. 12 is a view showing an ideal cross-section of the conventional male terminal.
Figure 13:
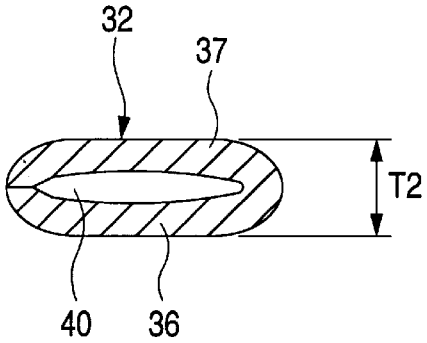
FIG. 13 PRIOR ART
FIG. 13 is a cross-sectional view taken along the line XIII—XIII of FIG. 11.

A seventh embodiment of a male terminal of the invention will be described with reference to FIGS. 9 and 10. As shown in FIGS. 9 and 10, a plurality of recesses (reinforcement portions) 24*a* are formed at a contact portion 24 by pressing, and these reinforcement portions 24*a* are held in contact with a bottom base portion 21. With this construction, effects similar to those of the above embodiments can be obtained. In this case, the reinforcement portions 24*a* are formed at other portions of the contact portion 24 than a contact area Z for contacting the female terminal (not shown).

As described above, according to the male terminal of the invention, the reinforcement portion is provided in the space between the bottom base portion and the contact portion of the connection portion of the male terminal, and therefore during transport, assembly and maintenance of the male terminal, the bottom base portion and the contact portion are positively prevented from being crushed and deformed. Therefore, an incomplete electrical connection of the connection portion to the female terminal will not occur.

And besides, the space can be positively formed between the bottom base portion and the contact portion, and therefore spring-back, occurring when bending the sheet material so as to superpose the bottom base portion and the contact portion together, can be absorbed by this space, and therefore the connection portion can be formed or shaped easily and precisely. Therefore, the quality and reliability of the male terminal are enhanced.

Further, according to the male terminal of the invention, the reinforcement portion, provided in the space between the bottom base portion and the contact portion, is formed at other portion of the connection portion than the contact area for electrical contact with the female terminal. Therefore, the precision of the position of the reinforcement portion does not need to be so high, and this facilitates the production, and reduces the cost of the male terminal.

Furthermore, according to the male terminal of the invention, the reinforcement portion, provided in the space between the bottom base portion and the contact portion, is formed by bending the electrically-conductive sheet material. Therefore, the reinforcement portion can be formed by bending simultaneously when forming the male terminal by bending the sheet material, and therefore the reinforcement portion can be easily formed.

Still further, according to the male terminal of the invention, the reinforcement portion, provided in the space between the bottom base portion and the contact portion, is formed by pressing. Therefore, as compared with the case of forming the reinforcement portion by bending the electrically-conductive sheet material, a wide choice of the position of formation of the reinforcement portion can be obtained, and the reinforcement portion can be formed at a suitable position.

What is claimed is:

1. A terminal, comprising:

an electrically conductive plate including a wire connecting portion for clamping a wire thereto and an electric connection portion for mating with another terminal, said connection portion including a bottom base portion and a contact portion which are superposed together; and a reinforcement portion formed in a space defined by said bottom base portion and said contact portion, wherein said bottom base portion has a flat shape, wherein said contact portion has a pair of contact pieces, and wherein said reinforcement portion is formed by bending edge portions of said contact pieces inwardly into said space, so that a portion of each of said contact pieces abut against said bottom base portion in a parallel to said bottom base portion.

2. A terminal, comprising:

an electric connection portion formed by a folded electrically conductive plate having side edges and a folded portion, wherein said side edges of said folded electrically conductive plate are adjacent each other, and said folded portion is disposed on said connection portion so as to be opposite from said side edges, to form a space within said folded electrically conductive plate, and wherein said electrically conductive plate includes a bent portion which bends inwardly into the space of the folded electrically conductive plate to reinforce the connection portion.

* * * * *